US009142160B2

(12) United States Patent
Goden et al.

(10) Patent No.: US 9,142,160 B2
(45) Date of Patent: Sep. 22, 2015

(54) DISPLAY APPARATUS

(75) Inventors: Tatsuhito Goden, Machida (JP); Masami Iseki, Mobara (JP)

(73) Assignee: Canon Kabushiki Kaisha, Tokyo (JP)

( * ) Notice: Subject to any disclaimer, the term of this patent is extended or adjusted under 35 U.S.C. 154(b) by 526 days.

(21) Appl. No.: 13/494,200

(22) Filed: Jun. 12, 2012

(65) Prior Publication Data

US 2012/0320101 A1 Dec. 20, 2012

(30) Foreign Application Priority Data

Jun. 20, 2011 (JP) ..... 2011-136532

(51) Int. Cl.
*G09G 3/32* (2006.01)

(52) U.S. Cl.
CPC ..... *G09G 3/3225* (2013.01); *G09G 3/3266* (2013.01); *G09G 2320/064* (2013.01)

(58) Field of Classification Search
None
See application file for complete search history.

(56) References Cited

U.S. PATENT DOCUMENTS

2002/0000960 A1 1/2002 Yoshihara et al.
2004/0130513 A1 * 7/2004 Miyazawa ..... 345/76
2006/0208656 A1 9/2006 Hara

FOREIGN PATENT DOCUMENTS

CN 1841472 A 10/2006
KR 10-2008-0098954 A 11/2008

* cited by examiner

*Primary Examiner* — Joseph Haley
(74) *Attorney, Agent, or Firm* — Canon USA, Inc., IP Division

(57) ABSTRACT

An exemplary embodiment of the present invention is a display apparatus. In the display apparatus, each row has as many row selection lines as the number of colors of light emitting elements, and row selection signals are supplied via the row selection lines such that a first row selection signal and a second row selection signals are supplied to driving circuits of light emitting elements of each color in first and second periods alternately and a plurality of times at different intervals in each frame. In the first period, light-emission or no-light-emission data signals are supplied over data lines. In the second period, only no-light-emission data signals are supplied. One of the first and second row selection signals is supplied with the same timing for all colors, while the other one of the row selection signals is supplied with timing different among the colors.

12 Claims, 7 Drawing Sheets

DISPLAY APPARATUS

BACKGROUND OF THE INVENTION

1. Field of the Invention

The present invention relates to a display apparatus, and more particularly, to a display apparatus using an organic electroluminescence (EL) display element.

2. Description of the Related Art

To achieve gray levels in an image displayed on an active matrix organic electroluminescent display apparatus, it is known to divide one frame period into a plurality of subframe periods, and rewrite data on a subframe-by-subframe basis to control emission of each pixel in each subframe. In the case of a color organic electroluminescent display apparatus, the display apparatus includes a plurality of pixels each including three organic electroluminescent elements capable of emitting light of red (R), green (G), and blue (B), respectively, and a white balance adjustment is performed by changing the ratio of luminance among the three organic electroluminescent elements.

U.S. Patent Application Publication No. 2006/0208656 discloses a technique in which timing of turning on organic electroluminescent elements of pixels into a light emission state is fixed for light of R, G, and B colors (hereafter referred to as RGB colors), while timing of turning off into an extinction or no light emission state is varied among the RGB colors to achieve a white color adjustment in each subframe.

To control the timing of turning off the organic electroluminescent elements into the extinction state individually for respective RGB colors, each EL driving circuit needs to include not only a circuit for turning on the corresponding organic electroluminescent element according to data but also a circuit for turning off the organic electroluminescent element. Furthermore, in addition to control lines for writing data in units of rows, three control lines are provided in each row to control transistors for turning off the organic electroluminescent elements of the respective RGB colors.

The provision of such additional control lines results in a reduction in layout space in which circuit elements such as transistors, capacitors, etc., of EL driving circuits are disposed, and thus it becomes difficult to realize a display apparatus with a small size and/or high resolution.

In view of the above, the present invention provides a display apparatus capable of adjusting white balance with a minimized number of circuit elements such as control lines, transistors forming an EL driving circuit, etc.

SUMMARY OF THE INVENTION

According to the first aspect of the present invention, a display apparatus comprising pixels arranged in a matrix wherein each pixel includes light emitting elements capable of emitting light of different colors and driving circuits for supplying currents to the light emitting elements is provided. The display apparatus further comprises row selection lines for supplying a first and a second row selection signals to the driving circuits.

The display apparatus further comprises data lines for supplying data signals to the driving circuits. Wherein the row selection lines are provided such that there are as many row selection lines in each row of pixels arranged in the matrix as the number of colors of light emitting elements and such that each row selection line in each row provides the first and the second row selection signals to driving circuits of light emitting elements of a corresponding same one of the colors. Wherein each one of the row selection lines provides to the driving circuits the first row selection signal in a first period during which the data lines provide data signals designating a light emitting state of the light emitting elements and the second row selection signal in a second period during which the data lines provide data signals designating light extinction of the light emitting elements such that the first and second row selection signals are supplied alternately and a plurality of times in each frame period. Wherein the row selection lines in each row provide the first row selection signals in the same first period and the second row selection signal in different second periods.

According to the second aspect of the present invention, a driving circuit array comprising driving circuits for driving light emitting elements arranged in a matrix each row of which includes the light emitting elements of different colors is provided. The driving circuit array further comprises row selection lines for supplying a first and a second row selection signals to the driving circuits.

The driving circuit array further comprises data lines for supplying data signals to the driving circuits. Wherein the row selection lines are provided such that there are as many row selection lines in each row as the number of colors of light emitting elements included in the row and such that each row selection line in each row provides the first and the second row selection signals to driving circuits for driving light emitting elements of a corresponding same one of the colors. Wherein each one of the row selection lines provides to the driving circuits the first row selection signal in a first period during which the data lines provide data signals designating a light emitting state of the light emitting elements driven by the driving circuits and the second row selection signal in a second period during which the data lines provide data signals designating light extinction of the light emitting elements driven by the driving circuits such that the first and second row selection signals are supplied alternately and a plurality of times in each frame period. Wherein the row selection lines in each row provide the first row selection signals in a same first period and the second row selection signal in different second periods.

According to the third aspect of the present invention, a method for driving a display apparatus including pixels arranged in a matrix wherein each pixel includes light emitting elements capable of emitting light of different colors and driving circuits for supplying currents to the light emitting elements, row selection lines for supplying a first and a second row selection signals to the driving circuits and data lines for supplying data signals to the driving circuits, is provided.

Wherein the row selection lines are provided such that there are as many row selection lines in each row of pixels arranged in the matrix as the number of colors of light emitting elements and such that each row selection line in each row provides the first and the second row selection signals to driving circuits of light emitting elements of a corresponding same one of the colors.

The method comprises steps of providing the first row selection signal to the driving circuits in a first period during which the data lines provide data signals designating a light emitting state of the light emitting elements, so that the first row selection signals supplied by the row selection lines in the row are provided in the same first period. The method further comprises providing the second row selection signal in a second period during which the data lines provide data signals designating light extinction of the light emitting elements, so that the second row selection signal supplied by the row selection lines in the row are provided in different second periods.

In the display apparatus according to the present aspect, each row has a plurality of row selection lines assigned to respective colors, and the supplying of light-emission data or no-light-emission data via the data lines and the supplying of only no-light-emission data are performed in different non-overlapping periods such that the operation of turning into the light emission state is not coincident with the operation of turning into the extinction state, thereby making it unnecessary to provide additional transistors for turning off the light emitting elements and signal lines for controlling the transistors for turning off the light emitting elements. Thus, it becomes possible to adjust the white balance without having to increase the number of circuit elements forming the EL driving circuit and the number of signal lines for controlling the EL driving circuit.

Further features of the present invention will become apparent from the following description of exemplary embodiments with reference to the attached drawings.

DESCRIPTION OF THE EMBODIMENTS

Figure 1:
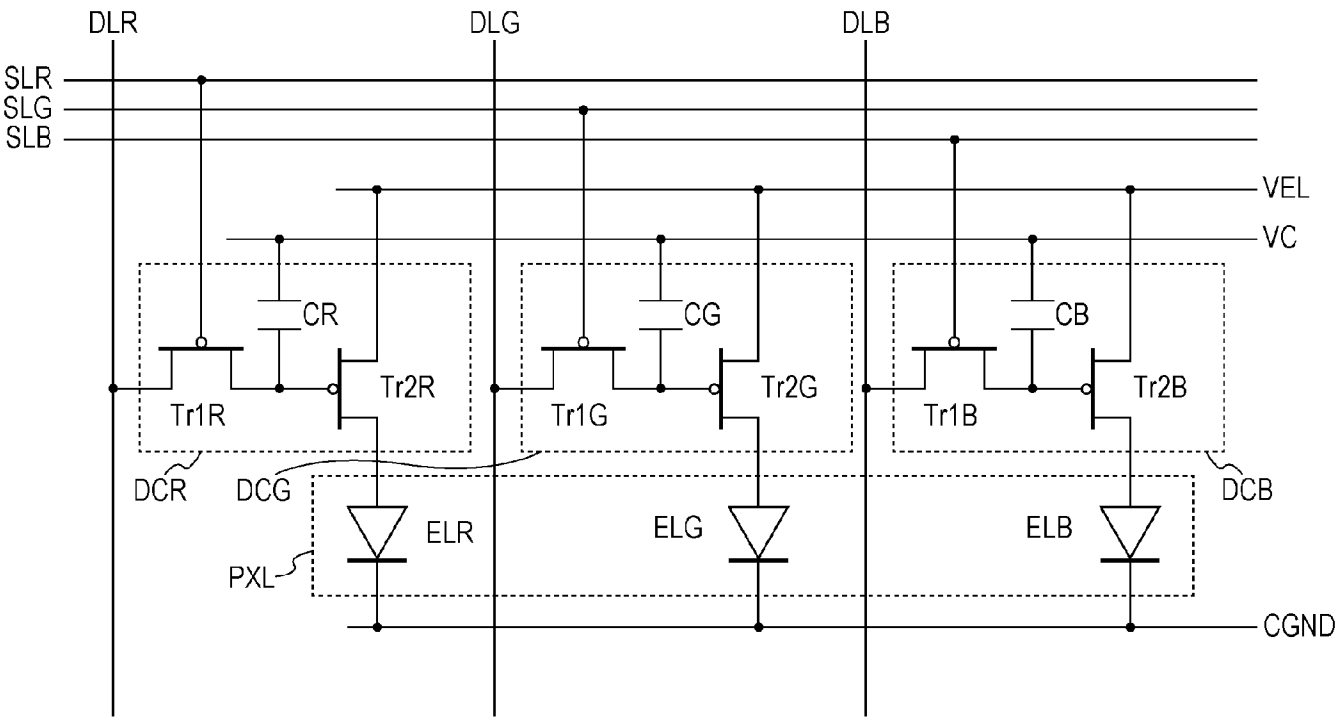
FIG. 1 is a diagram illustrating light emitting elements of three colors and driving circuits therefor in a display apparatus according to an embodiment of the present invention.

FIG. 1 is a circuit diagram illustrating a structure of one of pixels of an organic electroluminescent display apparatus according to an embodiment of the present invention.

One pixel includes three organic electroluminescent elements each capable of emitting one of light of three colors, i.e., red (R), green (G), and blue (B). Each organic electroluminescent element is connected to an EL driving circuit including a first transistor Tr1, a second transistor Tr2, and a storage capacitor C.

In FIG. 1, suffixes R, G, and B are used to distinguish among colors associated with circuit elements. In the present description, when an explanation is concerned with a general matter that is not specific to a particular color, no suffix is used.

In each EL driving circuit DC, as shown in FIG. 1, the transistor Tr1 is connected such that a gate thereof is connected to a row selection line SL, a drain thereof is connected to a data line DL, and a source thereof is connected to a gate of the transistor Tr2. When the row selection line SL goes to a selection signal level, the transistor Tr1 turns on and a voltage on the data line DL is transmitted to the storage capacitor C.

The transistor Tr2 is connected such that a source thereof is connected to a power supply VEL and a drain thereof is connected to an anode of the organic electroluminescent element EL. A cathode of the organic electroluminescent element EL is grounded. One end of the storage capacitor C is connected to the source of the transistor Tr1 and the gate of the transistor Tr2, and the other end of the storage capacitor C is maintained at a constant voltage Vc.

There are as many row selection lines SL per each row of a pixel matrix as the number of colors, and more specifically, in the present embodiment, there are three row selection lines SL in each row.

Driving circuits of organic electroluminescent elements of each same color in each row are connected to the same one of the row selection lines SL. More specifically, for the driving circuits DCR of the organic electroluminescent elements ELR of red (R), the gate of the transistor Tr1R of each driving circuit DCR is connected to the row selection line SLR of red (R). For the driving circuits DCG of the organic electroluminescent elements ELG of green (G), the gate of the transistor Tr1G of each driving circuit DCG is connected to the row selection line SLG of green (G). For the driving circuits DCB of the organic electroluminescent elements ELB of blue (B), the gate of the transistor Tr1B of each driving circuit DCB is connected to the row selection line SLB of blue (B).

To the three row selection lines SLR, SLG, and SLB, row selection signals are applied at the same time or at different timing points to turn on the transistors Tr1 whereby the EL driving circuits of R, G, and B colors (hereinafter referred to as RGB colors) are selected on a row-by-row basis to write voltages of data lines DL as image data to the selected EL driving circuits. At another timing point, no-light-emission data or light extinction data (black-level data) is written from the data lines DL.

The data lines DL are disposed such that one data line DL is provided for each column of an array of EL driving circuits DC such that image data or black-level data is supplied to EL driving circuits DC selected by the row selection lines SL. As will be described in more detail later with reference to FIG. 3, data is supplied via the data lines DL in periods that appear alternately, and more particularly, image data is supplied in one period (the first period) while only black-level data is supplied in the other period (the second period).

In the EL driving circuits shown in FIG. 1, the transistors Tr1 and Tr2 are all P-type MOS transistors. Alternatively, N-type MOS transistors may be used for both or one of the transistors Tr1 and Tr2. In this case, polarities are properly inverted for the power supply VEL and signals supplied via the row selection lines and the data lines. The transistors may be transistors formed on a silicon wafer or may be thin film transistors formed on a glass substrate. The organic electroluminescent elements EL may be replaced by other types of light emitting elements such as inorganic EL elements, LEDs, etc.

Figure 2:
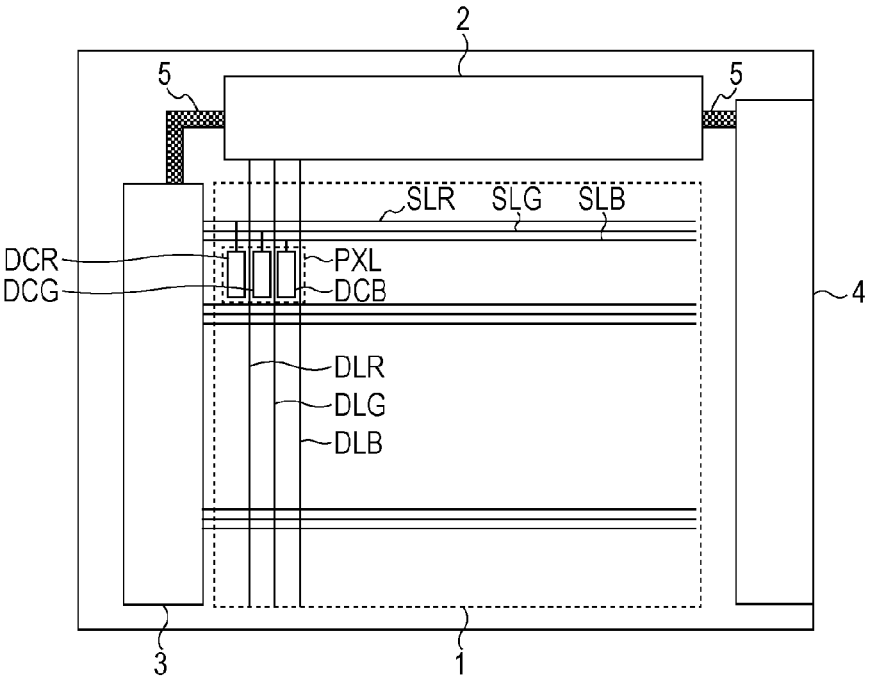
FIG. 2 is a block diagram illustrating a structure of a display apparatus according to an embodiment of the present invention.

FIG. 2 is a block diagram illustrating a structure of an organic electroluminescent display apparatus.

In a display area 1, pixels PXL each including three organic electroluminescent elements of red (R), green (G), and blue (B) shown in FIG. 1 are arranged in row and column directions in a matrix.

A horizontal signal generation circuit 2 generates data voltages for respective columns of the display area and supplies them over the corresponding data lines DL.

A vertical signal generation circuit 3 generates row selection signals by which to select rows individually for respective RGB colors and outputs the resultant row selection signals over corresponding row selection lines SLR, SLG, and SLB.

A connection terminal set 4 for inputting a clock signal, an image signal, etc., includes a set of terminals connected to the horizontal signal generation circuit 2 and the vertical signal generation circuit 3 via wirings 5.

When the clock signal, the image signal, etc. are input, these signals are transferred to the horizontal signal generation circuit 2 and the vertical signal generation circuit 3. In the display area 1, a power supply line VEL and a capacitor voltage line VC are also disposed, although they are not shown in FIG. 2.

Figure 3:
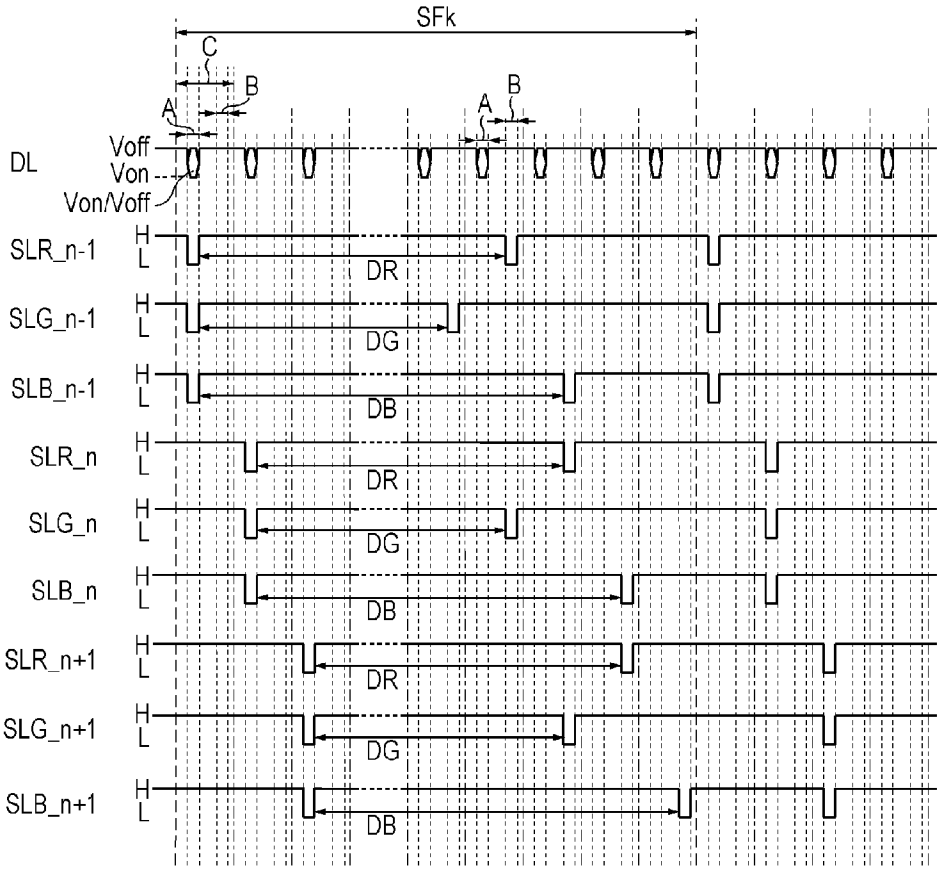
FIG. 3 is a timing chart illustrating an operation of a display apparatus according to an embodiment of the present invention.

FIG. 3 is a timing chart illustrating an operation of the display apparatus according to the present embodiment. In this chart, signals shown along a vertical axis from top to bottom are signal voltages supplied along the data line DL, RGB row selection lines SLR_n−1, SLG_n−1, and SLB_n−1 in the (n−1)th row, RGB row selection lines SLR_n, SLG_n, and SLB_n in the n-th row, and RGB row selection lines SLR_n+1, SLG_n+1, and SLB_n+1 in the (n+1)th row. A horizontal axis in this figure represents time.

In the display apparatus according to the present embodiment, one frame is divided into a plurality of subframes, and gradation representation is achieved by controlling length of a light emitting period in each subframe. This method is referred to as a subframe-controlled gradation method.

To achieve $2^N$ halftone levels in the gradation representation, one frame period is divided into N subframe periods. Hereinafter, a k-th subframe period is referred to as SFk where k is an integer in a range from 1 to N. The image signal input to the display apparatus is converted into N-bit digital gradation signal such that "1" or "0" of each bit of the signal indicates light emission/extinction in each subframe.

Each subframe period SFk is further divided into as many durations C as the number of rows such that the durations C are assigned to the respective rows. Each duration C includes at least a first period A and a second period B.

Each row selection line is applied with a row selection signal at timing points in the first period A and the second period B in synchronization with data.

In the period A, image data designating either light-emitting or non light-emitting as a state to be taken by the light emitting elements is supplied to the corresponding EL driving circuits via the data lines, while row selection signals are supplied via the row selection lines thereby writing the image data into the corresponding EL driving circuits. After the end of the period A, the image data is held by capacitors of the EL driving circuits such that the organic electroluminescent elements are maintained in the light emission state or the no light emission state designated by the written image data.

In the period B, only erase command data for turning light emitting elements into the no light emission state is supplied via the data lines and row selection signals that are the same as those given in the writing operation are supplied via the selection lines thereby performing a data erasing operation. Thereafter, the light emitting elements are maintained in the extinction or no light emission state.

In each subframe period SFk, as described above, each pixel performs the operation including four steps: (a) writing data, (b) turning into light emission state or no light emission state, (c) erasing data, and (d) turning into no light emission state. The above-described operation including the four steps is performed a plurality of times (as many times as the number of subframes) in each frame period.

First, the operation in step (a) is described below.

In the period A, the data lines DL provide to the EL driving circuits image data Von indicating that organic electroluminescent elements are to be turned into the light emission state and maintained in the light emission state or image data Voff indicating that organic electroluminescent elements are to be turned into the no light emission state and maintained in the no light emission state. The image data is applied individually to the respective organic electroluminescent elements whereby each organic electroluminescent element in each pixel is determined to be turned into the light emission state or the no light emission state.

In the period A, to perform the writing, the row selection signal (L-level) is supplied over the row selection line SLn−1.

In the next duration C, this operation is performed for the row selection line SLn in the next row. Similarly, the operation is performed for the row selection line SLn+1 and following row selection lines sequentially in corresponding durations C. Because the image data Von or Voff is supplied over the data lines DL during the period A as described above, the writing of data (operation in step (a)) is performed sequentially from one row to next. During the period A, the row selection signals are applied in the same period A to the row selection lines SLR, SLG, SLB of the respective RGB colors of row, and the image data is written at the same time into the EL driving circuits of the respective RGB colors.

After the application of the row selection signals is complete, the row selection lines are returned to the non-selection level (H-level), and the respective EL driving circuits DC hold the written image data at their storage capacitors C. Each pixel then proceeds to step (b) to perform the light emission operation. A current is supplied to the organic electroluminescent elements connected to EL driving circuits having image data Von, and thus light is emitted. On the other hand, no current is supplied to the organic electroluminescent elements connected to EL driving circuits having image data Voff, and thus these organic electroluminescent elements turn into the no light emission state.

When a time D has elapsed since the application of the row selection signal to the row selection line SL in the period A, a second row selection signal is applied to the row selection line SL in the period B. In the period B, the data lines DL provide erase command data (black level data) Voff designating the no light emission state to the EL driving circuits. In this period B, all data lines are applied with only the erase command data Voff and data Von designating the light emission state is not applied to any data line. The second row selection signal applied in the period B causes all organic electroluminescent elements in the selected row to turn into the no light emission state.

The second raw selection signals are applied to the three row selection lines in a row in different periods B.

Also in the case of the row selection signal in the period B, the row selection signal is applied to the row selection lines sequentially from one row to next as the duration C proceeds from one to next. Because the black-level data Voff is applied to the data lines DL over the period B, the erasing of data (operation in step (c)) is performed from one row to next.

The row selection line SL applied with the row selection signal in the period B returns then to the non-selection level (H), and thus the organic electroluminescent elements proceed to step (d) to turn into the no light emission state. This state is maintained until the writing of data (operation step (a)) is started for a next subframe.

Each row selection line has alternately periods A and periods B such that writing of image data is performed in each period A and erasing of data is performed in each period B.

In each subframe period SF, a period from the end of the period A to the start of the period B is a light emission period D. The light emission period D can be adjusted by changing the timing of the period B while fixing the period A. That is, the length of the light emission period can be increased by delaying the timing of the start of the period B.

In the example above, as for the three row selection lines in a row, the period A is common but the period B is different.

It is also possible to adjust the light emission period D by changing the timing of the period A while fixing the period B. However, the horizontal circuit normally generates the image data according to fixed timing. In this case, it is advantageous to change the light emission period by changing the timing of the period B while fixing the timing of the period A. Because the period B is a period in which the black-level data Voff is written, row selection signals for different colors can be simultaneously applied.

In the example shown in FIG. 3, a row selection signal for erasing blue (B) data in the (n−1)th row, a row selection signal for erasing red (R) data in the n-th row, and a row selection signal for erasing green (G) data in the (n+1)th row are applied simultaneously to erase the data of all colors in these rows at the same time.

The operation including steps (a) to (d) described above is performed sequentially from one row to next in each subframe period SF whereby the luminance in the subframe period is determined. The operation including steps (a) to (d) are performed in other subframes in a similar manner to that described above except that the period D in which step (b) is performed, i.e., the period from the end of the application of the row selection signal in step (a) in the period A to the start of the application of the row selection signal in step (c) in the period B varies from one subframe to another. In the case where there are 256 gradation levels, the number N of subframes is set to eight. By setting the subframes SF1 to SF8 to have lengths of 1:2:4:8:16:32:64:128 in ratio, it is possible to realize 256 gradation levels. This ratio of the light emission periods are set to be equal for the RGB colors, even though the light emitting periods are different.

IF the light emission periods are set to be equal regardless of color, the white balance is determined by the ratio of luminance among light of the RGB colors being emitted. Therefore, in this case, to adjust the white balance, it is necessary to adjust the luminance of colors being emitted. This results in an increase in complexity of the display apparatus, and more specifically, for example, it is necessary to provide power supply voltages VEL individually for the RGB colors.

In the present embodiment, as described above with reference to FIG. 3, row selection lines SLR, SLG, and SLB of the RGB colors are provided separately, and thus it is possible to set the timing of the period A or the period B individually for the respective RGB colors. This makes it possible to adjust the white balance by adjusting the light emission periods of the RGB colors.

Let it be assumed that the correct white balance is achieved when the ratio among the luminance of the red, green, and blue is R:G:B=x:y:z (x+y+z=1). If the ratio of luminance (average taken over time) is set to be equal to the above ratio in every subframe, then the ratio of luminance for the complete one frame is equal to this value. Therefore, to emit light of the respective colors with luminance $I_R$, $I_G$, and $I_R$, the light emission periods $D_R(k)$, $D_G(k)$, and $D_B(k)$ for the k-th subframe can be determined as $$I_R D_R(k)/1F = x\cdot(I_W/2^{N-k+1}),$$

$$I_G D_G(k)/1F = y\cdot(I_W/2^{N-k+1}), \text{ and}$$

$$I_B D_B(k)/1F = z\cdot(I_W/2^{N-k+1})$$

where k is an integer varying from 1 to N, 1F is the length of one frame period, and $I_W$ is the luminance of white.

As can be seen from these equations, although the light emission periods of the RGB colors can vary from one subframe to another, the ratio of light emission periods among subframes is $1:2:4:8:\ldots:2^{N-1}$ equally for all colors.

In the present embodiment, as described above, the row selection lines are provided such that each row has as many row selection lines as the number of colors, i.e., each row has row selection lines assigned to the respective RGB colors. The light emission period for each row selection line, i.e., the period from the end of the application of the row selection signal in the period A to the start of the application of the row selection signal in the period B is controlled separately for each color to achieve the correct white balance.

In the case of an analog gradation method, to correct a difference in gamma characteristic among colors, it is needed to provide a gamma correction circuit to adjust the white balance (gray balance) in a halftone range.

However, in the subframe-controlled gradation method, the luminance in the halftone range is determined by the light emission period in the subframe, and thus the ratio of the light emission periods in the respective subframes to the total light emission period is equal for all colors. Therefore, first, the ratio of the total light emission period taken over the all subframes among the RGB colors is determined from the white balance (x:y:z), and then the total light emission period are distributed among the subframes with the ratio of $1:2:4:8:\ldots:2^{N-1}$ in each color. Thus, in the subframe-controlled gradation method, it is sufficient to set the RGB intensity ratio only for white, and the gamma correction is not necessary.

By configuring the vertical signal generation circuit 3 to be capable of setting the timing of row selection signals in the period A or the period B individually for the RGB colors, it becomes possible to arbitrarily adjust the white balance. In a state in which the luminance is adjusted for respective colors to obtain particular white balance, it is possible to make an adjustment to obtain a desired white tone. In a case where adjustment has already been achieved for the luminance of two of the RGB colors, the light emission period for the remaining one color may be adjusted while maintaining the light emission periods of the first two colors. In this case, the timing of the row selection line corresponding to the remaining one color is adjusted differently from the two row selection lines corresponding to the first two colors.

Because the ratio among subframes in terms of the interval between the period A and the period B is the same for all RGB colors, it is sufficient to adjust the total light emission periods over all subframes or adjust the light emission periods of the RGB colors in one subframe and set the light emission periods for the remaining other subframes such that the light emission periods are given simply by multiplying the total period by predetermined factors without adjusting the timing individually for the respective subframes.

Figure 4:
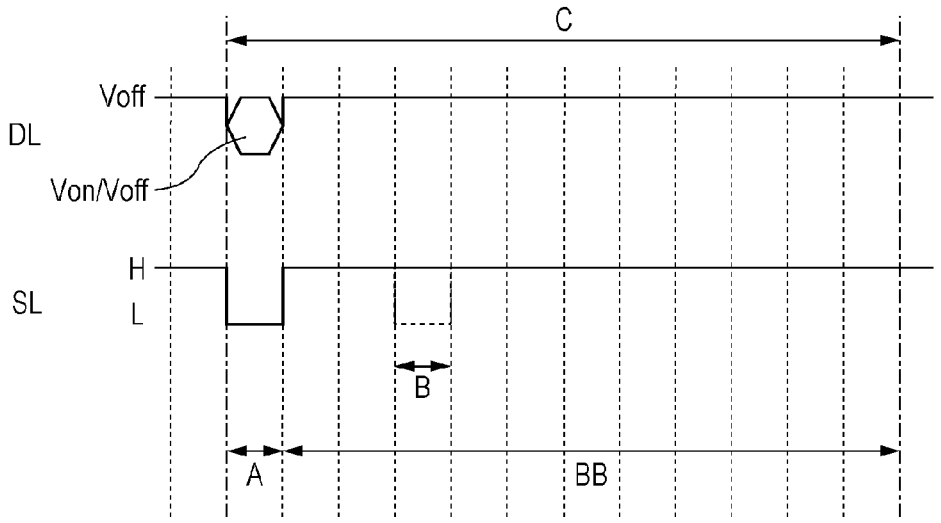
FIG. 4 is a diagram illustrating timing of turning into a light emission state and turning into an extinction state according to an embodiment of the present invention.

FIG. 4 is a diagram illustrating another driving method different from that shown in FIG. 3.

In the method described above with reference to FIG. 3, the light emission period D is adjusted by shifting the selection period in a forward or opposite direction in units of durations C. However, the length of the duration C cannot be shorter than the sum of the length of the period A and the length of the period B in which data is written in one row, and thus the resolution of the adjustment of the timing of turning off into the no light emission state cannot be higher than that corresponding to the sum of the two periods. However, it is required to adjust the light emission periods more finely when there are more gradation levels.

The driving method shown in FIG. 4 makes it possible to adjust the timing of turning off light emission within one selection period. The duration C is set to be sufficiently long, and a period BB which includes a plurality of the period B remaining after the period A, is set to be a several times longer than the period A in which data designating light emission/no light emission is supplied. In the period other than the period A, black-level data designating the no light emission state is supplied over the data lines DL.

In the specific example shown in FIG. 4, the period BB is set to be eleven times longer than the period A so that eleven periods for providing an erasing or black-level signal follow the period A. The period in which the row selection signal is applied is set at a proper timing point within the black level data supply period. There is no overlap between the period A and the period BB. In the example shown in FIG. 4, the timing of turning off light emission can be set in the duration C in eleven different manners, which makes it possible to adjust the light emission period with high resolution.

Figure 5:
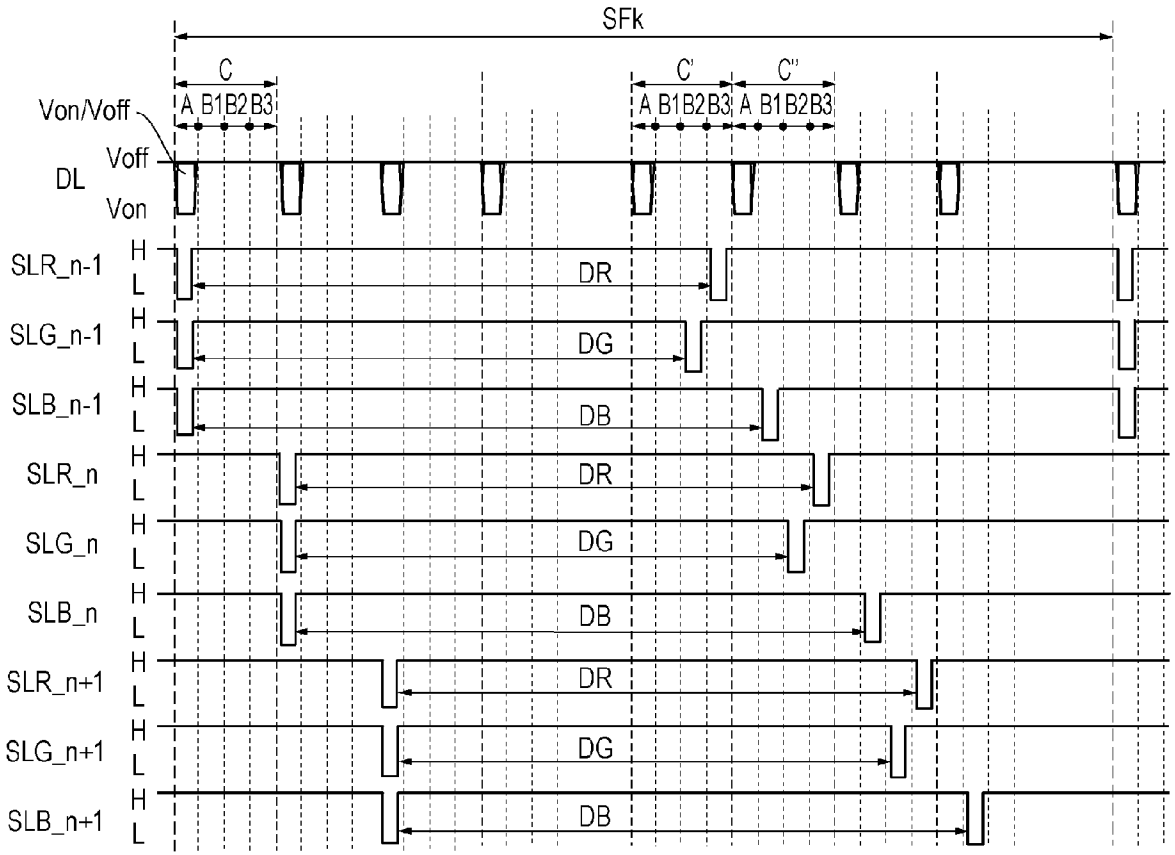
FIG. 5 is a timing chart illustrating an operation according to the embodiment shown in FIG. 4.

FIG. 5 is a timing chart illustrating a driving method for a case where the timing of turning off light emission is adjusted within selection periods in one row. In this example, unlike the example shown in FIG. 4, the timing of turning into the no light emission state is adjusted in a period BB selected from three periods B1, B2, and B3. In FIG. 5, similar data and similar periods to those in FIG. 3 are denoted by similar reference symbols.

In each subframe SFk, after a period A in which data designating the light emission state or the no light emission state as the state to be taken by the pixels is supplied, black-level data designating turning-off of light emission is transmitted successively three times over data lines.

Writing of data is performed when a row selection signal is supplied in each period A at the beginning of each of durations C to sequentially select rows. In the same subframe SFk, turning into the no light emission state is performed when a row selection signal for turning off light emission is supplied in one of three periods B1, B2, and B3 following the period A.

A duration C' in which turning-off of light emission is performed is usually different from a duration C in which writing of data is performed. The turning-off of light emission is performed in a duration C' usually different from a duration C in which writing of data is performed, although both writing of data and turning-off light emission are performed in the same duration C when the light emission period is extremely short. In FIG. 5, data is written in pixels in an (n−1)th row in the period A in the duration C. The pixels in the same row are subjected to the turning-off operation such that red (R) is turned off in the period B3 in the duration C', green (G) is turned off in the period B2 in the duration C', and blue (B) is turned off in the period B1 in the next duration C". The setting of the timing of turning off light emission in a period selected from the three periods B1, B2, and B3 makes it possible to adjust the white balance with higher resolution.

In the following, operation of EL driving circuit is explained precisely.

FIGS. 6A to 6D are diagrams illustrating an operation of an EL driving circuit. The operation is similar for all EL driving circuits of RGB colors, and thus only one EL driving circuit is shown in the figures. In FIGS. 6A to 6D, similar elements to those in FIG. 1 are denoted by reference symbols which are similar to those in FIG. 1 except that suffixes are omitted.

As described above with reference to FIG. 3, the operation of the EL driving circuit includes the following four steps: (a) writing data, (b) emitting light, (c) erasing data, and (d) turning into no light emission state.

Figure 6A:
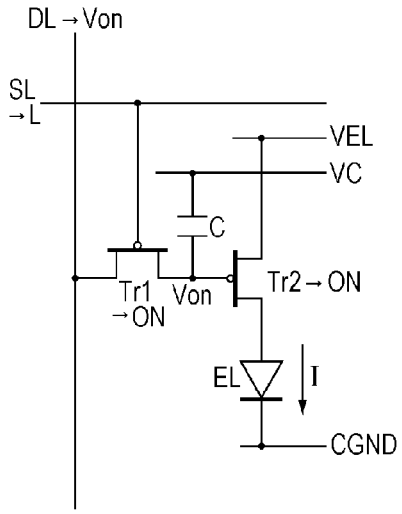
FIGS. 6A to 6D are diagrams illustrating an operation of a driving circuit.

FIG. 6A illustrates the operation of writing data in step (a).

The data line DL is at a data voltage equal to Von given by the horizontal signal generation circuit 2, i.e., the organic electroluminescent element is designated to emit light. The row selection line SL is at the selection level, i.e., the L-level given by the vertical signal generation circuit 3. Thus, the transistor Tr1 turns on and the data voltage Von is applied to the gate of the transistor Tr2. A voltage equal to VC−Von is applied across the storage capacitor. In response to the data voltage Von designating the light emission state, the transistor Tr2 turns on to supply a current I from the power supply VEL to the organic electroluminescent element EL thereby turning on the organic electroluminescent element EL into the light emission state.

In a case where the organic electroluminescent element EL is not to be turned on into the light emission state, the data voltage equal to Voff designating the no light emission state for the organic electroluminescent element is applied to the data line DL.

Figure 6C:
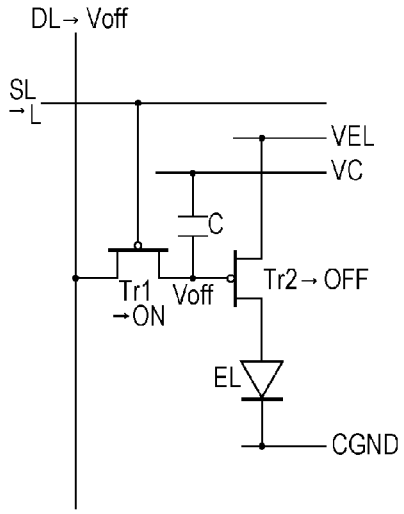
Figure 6B:
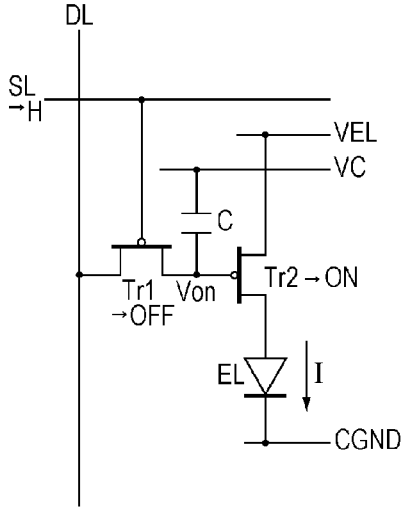

After the data is written, the EL driving circuit is brought into a state shown in FIG. 6B.

The row selection line SL is turned into the non-selection level, i.e., the H-level thereby turning the transistor Tr1 into the OFF state (non conduction state). The storage capacitor C holds the voltage VC−Von applied across it, and thus the gate terminal of the transistor Tr2 remains at the data voltage Von and the transistor Tr2 remains in the ON state. As a result, the organic electroluminescent element EL remains in the light emission state.

FIG. 6C illustrates the turning-off operation. The voltage on the data line DL applied by the horizontal signal generation circuit 2 turns to the data voltage equal to Voff designating the no light emission state as the state to be taken by the organic electroluminescent element. The voltage of the row selection line SL applied by the vertical signal generation circuit 3 turns again into the selection level, i.e., the L-level. As a result, the transistor Tr1 turns into the ON state, and the data voltage Voff is applied to the gate terminal of the transistor Tr2. A voltage equal to VC−Voff is applied across the storage capacitor. In response to the data voltage Voff designating the no light emission state, the transistor Tr2 turns into the OFF state and thus the current I from the power supply VEL to the organic electroluminescent element is shut off and the organic electroluminescent element EL is turned from the light emission state into the no light emission state. Note that the organic electroluminescent element EL that has been turned into the no light emission state in step (a) remains in the no light emission state.

Figure 6D:
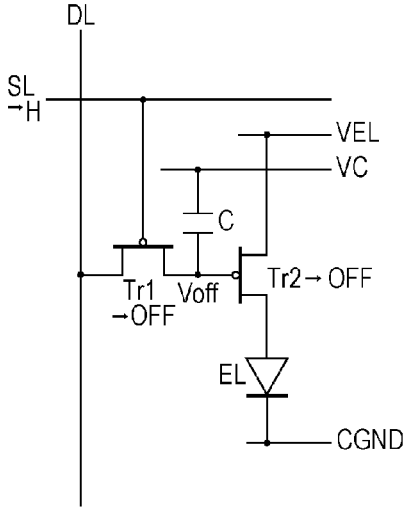

Thereafter, the EL driving circuit is brought into a state shown in FIG. 6D. That is, the row selection line SL is turned into the non-selection level, i.e., the H-level, and the transistor Tr1 turns into the OFF state. The voltage across the storage capacitor C is maintained at VC−Voff. Thus the gate terminal of the transistor Tr2 remains at the data voltage Voff, and the transistor Tr2 remains in the OFF state. As a result, the organic electroluminescent element EL remains in the no light emission state.

Vertical Signal Generation Circuit

Figure 7:
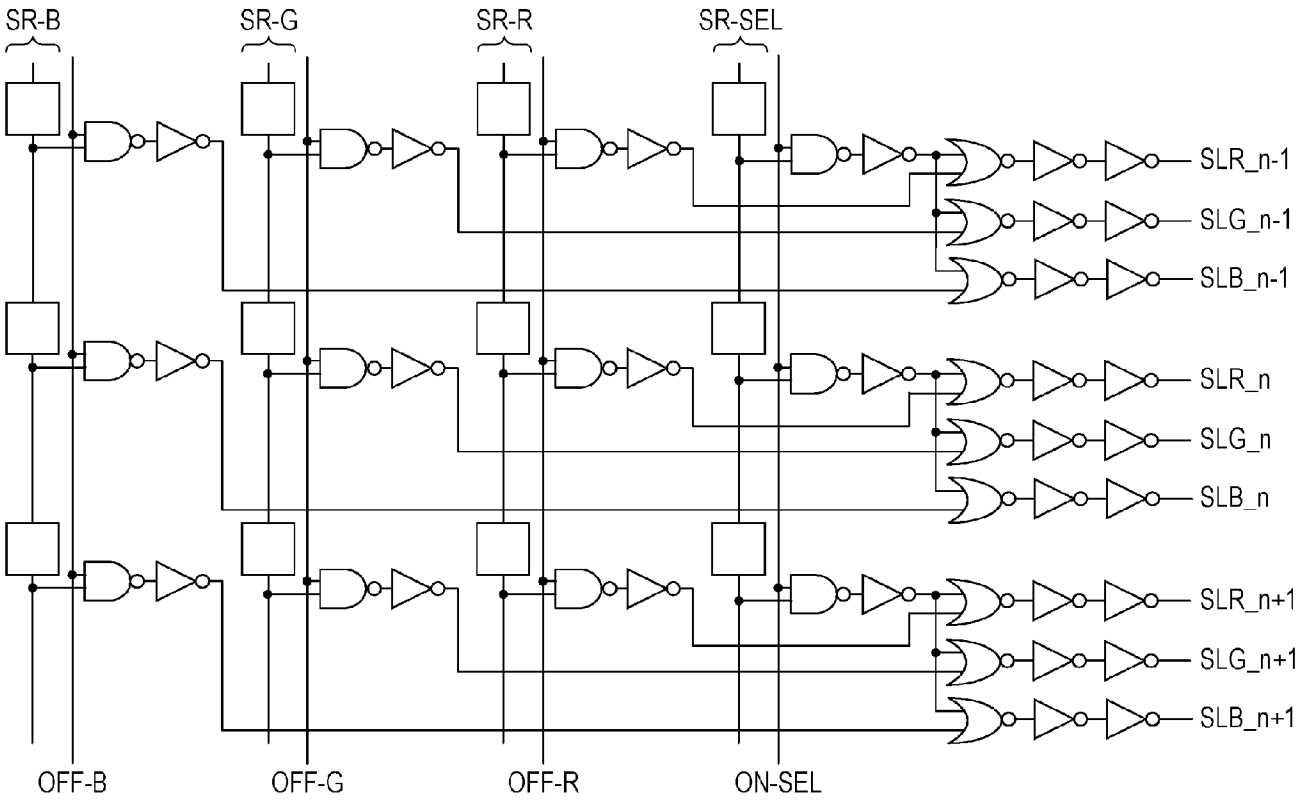
FIG. 7 is a circuit diagram of a vertical signal generation circuit.

FIG. 7 is a circuit diagram illustrating an example of a vertical signal generation circuit.

A shift register SR-SEL is provided for generating a pulse in the period A shown in FIG. 3. A logic AND operation is performed between an ON-SEL signal and a signal output from the stage corresponding to each row of the shift register, and a result is provided as a pulse that is at the L-level only during the period A in the duration C.

Shift registers SR-R, SR-G, and SR-B are provided for generating pulses to be output to the respective row selection lines SLR, SLG, and SLB in the period B shown in FIG. 3. A logic AND operation is performed between a signal output from the respective stages of shift registers and OFF-R, OFF-G, and OFF-B signals, respectively, and results are provided as pulses that are at the L-level only during the period B.

In the embodiments described above, it is assumed by way of example that the light emitting elements are organic electroluminescent elements. Note that other types of light emitting elements such as inorganic EL elements, LEDs, etc. may also be used. In the embodiments described above, it is also assumed by way of example that each pixel includes three organic electroluminescent elements of RGB colors. However, each pixel may include light emitting elements of two or more colors, and another combination of colors may be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-136532 filed Jun. 20, 2011, which is hereby incorporated by reference herein in its entirety.

What is claimed is:

1. A display apparatus comprising: pixels arranged in a matrix wherein each pixel includes light emitting elements capable of emitting light of different colors; driving circuits for supplying currents to the light emitting elements; row selection lines for supplying a first and a second row selection signals to the driving circuits; and data lines for supplying data signals to the driving circuits, wherein the row selection lines are provided such that there are as many row selection lines in each row of pixels arranged in the matrix as the number of colors of light emitting elements and each of the row selection lines is connected to a corresponding one of the light emitting elements and such that each row selection line in each row provides the first and the second row selection signals to driving circuits of light emitting elements of a corresponding same one of the colors, wherein each one of the row selection lines provides to the driving circuits the first row selection signal in a first period during which the data lines provide data signals designating a light emission state or a no light emission state of the light emitting elements and the second row selection signal in a second period during which the data lines provide data signals designating the no light emission state of the light emitting elements such that the first and second row selection signals are supplied alternately and a plurality of times in each frame period, and wherein the row selection lines in each row provide the first row selection signals in the same first period and the second row selection signal in different second periods, wherein intervals between the first row selection signal and the subsequent second row selection signal supplied by the row selection line are changed according to an adjustment of white balance of the display apparatus, and wherein a ratio of intervals between the first row selection signal and the subsequent second row selection signal supplied a plurality of times in a frame period by the row selection line is not changed by the adjustment.

2. The display apparatus according to claim 1, wherein the ratio in the order of length is 1:2:4:8 and so on.

3. The display apparatus according to claim 1, wherein the first period is followed by a plurality of the second periods.

4. The display apparatus according to claim 1, wherein each light emitting element is connected to a driving circuit including a first transistor, a second transistor, and a storage capacitor, wherein the first transistor in the driving circuit is connected such that a source thereof is connected to corresponding one of the data lines, a drain thereof is connected to the storage capacitor, and a gate thereof is connected to corresponding one of the row selection lines, and wherein the second transistor in the driving circuit is connected such that a source thereof is connected to a power supply, a drain thereof is connected to the light emitting element, and a gate thereof is connected to the drain of the first transistor and the storage capacitor.

5. A driving circuit array comprising: driving circuits for driving light emitting elements arranged in a matrix each row of which includes the light emitting elements of different colors; row selection lines for supplying a first and a second row selection signals to the driving circuits; and data lines for supplying data signals to the driving circuits, wherein the row selection lines are provided such that there are as many row selection lines in each row as the number of colors of light emitting elements included in the row and each of the row selection lines is connected to a corresponding one of the light emitting elements and such that each row selection line in each row provides the first and the second row selection signals to driving circuits for driving light emitting elements of a corresponding same one of the colors, wherein each one of the row selection lines provides to the driving circuits the first row selection signal in a first period during which the data lines provide data signals designating a light emitting state or a no light emitting state of the light emitting elements driven by the driving circuits and the second row selection signal in a second period during which the data lines provide data signals designating the no light emitting state of the light emitting elements driven by the driving circuits such that the first and second row selection signals are supplied alternately and a plurality of times in each frame period, and wherein the row selection lines in each row provide the first row selection signals in a same first period and the second row selection signal in different second periods, wherein intervals between the first row selection signal and the subsequent second row selection signal supplied by the row selection line are changed according to an adjustment of luminance of the light emitting elements of each color, a ratio of intervals between the first row selection signal and the subsequent second row selection signal supplied a plurality of times in a frame period is not changed by the adjustment.

6. The driving circuit array according to claim 5, wherein the ratio in the order of length is 1:2:4:8 and so on.

7. The driving circuit array according to claim 6, wherein the first period is followed by a plurality of the second periods.

8. The driving circuit array according to claim 6, wherein each driving circuit including a first transistor, a second transistor, and a storage capacitor, wherein the first transistor in the driving circuit is connected such that a source thereof is connected to corresponding one of the data lines, a drain thereof is connected to the storage capacitor, and a gate thereof is connected to corresponding one of the row selection lines, and wherein the second transistor in the driving circuit is connected such that a source thereof is connected to a power supply, a drain thereof is connected to the light emitting element driven by the driving circuit, and a gate thereof is connected to the drain of the first transistor and the storage capacitor.

9. A method for driving a display apparatus including pixels arranged in a matrix wherein each pixel includes light emitting elements capable of emitting light of different colors, driving circuits for supplying currents to the light emitting elements, row selection lines for supplying a first and a second row selection signals to the driving circuits, and data lines for supplying data signals to the driving circuits, the row selection lines being provided such that there are as many row selection lines in each row of pixels arranged in the matrix as the number of colors of light emitting elements and each of the row selection lines is connected to a corresponding one of the light emitting elements and such that each row selection line in each row provides the first and the second row selection signals to driving circuits of light emitting elements of a corresponding same one of the colors, said method comprising steps of: providing the first row selection signal to the driving circuits in a first period during which the data lines provide data signals designating a light emitting state or a no light emitting state of the light emitting elements, so that the first row selection signals supplied by the row selection lines in the row are provided in the same first period; and providing the second row selection signal in a second period during which the data lines provide data signals designating light extinction of the light emitting elements, so that the second row selection signal supplied by the row selection lines in the row is provided in different second periods, wherein intervals between the first row selection signal and the subsequent second row selection signal supplied by the row selection line are changed according to an adjustment of white balance of the display apparatus, and a ratio of intervals between the first row selection signals and the subsequent second row selection signals supplied a plurality of times in a frame period is not changed by the adjustment.

10. The method according to claim 9, wherein the step providing the first row selection signal and the step providing the second row selection signal are conducted a plurality of times respectively in a frame period.

11. The method according to claim 9, wherein ratios of intervals between the first row selection signals and the subsequent second row selection signals supplied by the row selection lines in the row are equal.

12. The method according to claim 9, wherein the first period is followed by a plurality of the second periods.

* * * * *